US005387900A

United States Patent [19]

Plonsky et al.

[11] Patent Number: 5,387,900

[45] Date of Patent: Feb. 7, 1995

[54] EAS SYSTEM WITH IMPROVED PROCESSING OF ANTENNA SIGNALS

[75] Inventors: Christopher B. Plonsky, Boca Raton; Jack H. Schneider, Coral Springs; Stanley A. Strzelec, Boca Raton, all of Fla.

[73] Assignee: Sensormatic Electronics Corporation, Deerfield Beach, Fla.

[21] Appl. No.: 979,612

[22] Filed: Nov. 19, 1992

[51] Int. Cl.[6] ..... G08B 13/14

[52] U.S. Cl. ..... 340/572; 340/551

[58] Field of Search ..... 340/572, 551; 343/742

[56] References Cited

U.S. PATENT DOCUMENTS

| | | | |
|---|---|---|---|
| 4,135,183 | 1/1979 | Heltemes | 340/572 |
| 4,243,980 | 1/1981 | Lichtblau | 340/572 |
| 4,260,990 | 4/1981 | Lichtblau | 343/742 |
| 4,309,697 | 1/1982 | Weaver | 340/572 |
| 4,489,313 | 12/1984 | Pfister | 340/540 |
| 4,710,752 | 12/1987 | Cordery | 340/551 |
| 4,751,516 | 6/1988 | Lichtblau | 343/742 |
| 4,859,991 | 8/1989 | Watkins et al. | 340/572 |
| 4,975,681 | 12/1990 | Watkins et al. | 340/572 |
| 5,005,001 | 4/1991 | Cordery | 340/572 |
| 5,049,857 | 9/1991 | Plonsky et al. | 340/551 |
| 5,126,749 | 6/1992 | Kaltner et al. | 343/742 |

*Primary Examiner*—John K. Peng
*Assistant Examiner*—Benjamin C. Lee
*Attorney, Agent, or Firm*—Robin, Blecker, Daley & Driscoll

[57] ABSTRACT

An EAS system in which first and second received signals are independently front-end processed to produce third and fourth signals indicative of the absolute values of the first and second processed signals. The third and fourth signals are then combined and the combined signal passed to a tag evaluation processor for time and frequency domain processing for evaluating whether a tag is present in an interrogation zone. The front-end processing is carried out in such a way that interference signal content including shield interference is extracted without extracting tag signal content in the received signals over a period of time. In this way, the first and second transmitter antennas of the system can be driven with drive signals having a phase difference of other than 0° or 180° and the tag evaluation processing can be carried out during the entire period of the drive signals.

35 Claims, 2 Drawing Sheets

EAS SYSTEM WITH IMPROVED PROCESSING OF ANTENNA SIGNALS

BACKGROUND OF THE INVENTION

This invention relates to electronic article surveillance (EAS) systems and, in particular, to EAS systems which utilize processing of received signals.

U.S. Patent 4,859,991, assigned to the same assignee hereof, discloses an EAS system of the magnetic type in which a low frequency magnetic signal or field at a preselected transmitter frequency is transmitted into an interrogation zone. If a magnetic tag is present in the zone, the tag interacts with the transmitted field to cause perturbations in the field at harmonics of the transmitter frequency.

Magnetic fields are received by the system from the interrogation zone and processed by a front-end processor to remove or extract interference signal content in the received signals. The resultant front-end processed signal is then further analyzed or processed via a tag evaluation processor to determine whether the signal contains any tag signal content. If the analysis indicates the presence of tag signal content, an alarm is sounded to indicate that a tag is present in the interrogation zone.

In the '991 patent, various types of interference signals are extracted by the front-end processor. One type of interference results from the power line signal used to supply power to the system components and other equipment adjacent to the interrogation zone. In the '991 patent system, the front-end processor extracts this interference via a comb notch filter having rejection bands at the power line frequency and its harmonics.

Another type of interference present in the '991 patent system is that originating from the interaction of the transmitted magnetic field with the magnetic shielding used to confine the transmitted field to the interrogation zone. This shielding results in so-called "shield-spike" interference in the received signals. Shield-spikes occur at the peaks of the transmitted field and, thus, are spaced in time at one-half the period of the transmitted field.

The processing in the '991 patent system eliminates shield-spike interference by utilizing blanking. Blanking blanks out the front-end processed signal over blanking periods which occur at the peaks of the transmitted signal. Thus, during the blanking periods, no signal is processed by the tag evaluation processor and, therefore, such processing is unaffected by the shield-spike interference.

In the '991 patent system, the front-end processed signals are conveyed to the tag evaluation processor during a window which precedes each blanking period. Each window occurs at a zero cross-over point of the transmitted field. During each blanking period, the evaluation processor processes frequency and time domain information received from the front-end processor during the preceding window. The system of the '991 patent, thus, operates in successive frames each formed by a window and blanking period which together cover one-half the period of the transmitted field.

Also, in the '991 patent system, the system utilizes two transmitter antennas which are driven at 180° out of phase relative to one another. This results in shield spikes in the received signals from the two transmitted signals which occur at substantially the same time. As a result, the same blanking periods and windows can accommodate the received signals resulting from the two transmitted signals.

U.S. Pat. No. 4,975,681, also assigned to the same assignee hereof, discloses a technique for improving the front-end processor of the '991 patent system. In particular, the '681 patent discloses a technique which when used in the '991 patent system is capable of removing both the power line and shield spike interference from the received signals. In the disclosed technique, the drive signal establishing the drive for the transmitter antennas is locked or synchronized in time with the power line signal while a time delay filter having a delay related to the period of the power line signal is used to filter the received signals. By suitable selection of the time delay, the power line and the shield-spike interference in the received signals is rejected and not passed by the filter, while the tag signal content is allowed to pass for a finite period of time.

The '991 patent system as modified by the '681 patent technique has certain limitations. First, the 180° phase difference between the drive signals of the transmitter antennas results in regions in the interrogation zone, particularly, in the middle of the zone between the two antennas which have little or no resultant field in the horizontal direction. This limits the ability of the system to detect tags oriented in this direction. Also, in systems where the system is transmitter field limited, the use of a blanking period during each processing frame limits the detection at a given interrogation zone width. It also limits the interrogation zone width over which tags can be detected. Additionally, the use of a blanking period increases the overall transmit field requirements for a given zone width.

Furthermore, in the '991 patent system, two receiver antennas are used. These antennas are placed in series or parallel to best combine the received signals from the two antennas. However, this still results in cancellation of tag signal content when opposite polarity tag signals are combined.

It is, therefore, an object of the present invention to provide an EAS system of the '991 patent type which does not suffer from the above disadvantages.

It is a further object of the present invention to provide an EAS system of the '991 patent type in which the system can have a wider interrogation zone, more effective detection for a given width of the zone and reduced transmit field requirements for a given width of the zone.

It is yet a further object of the present invention to provide an EAS system of the '991 patent type in which the system is less prone to cancellation effects which result when the received signals from multiple receiver antennas are combined.

It is also an object of the present invention to provide an EAS system of the '991 patent type in which the system utilizes multiple transmitter antennas and is operated so as to provide field components in all directions in the interrogation zone.

SUMMARY OF THE INVENTION

In accordance with the principles of the present invention the above and other objectives are realized in an EAS system of the '991 patent type in which the front-end processor is adapted to independently receive and process first and second signals from the interrogation zone and to produce third and fourth signals indicative of the absolute values of the processed first and second signals. The third and fourth signals are then additively combined and the combined signal conveyed to the tag evaluation processor wherein the signal is further processed in order to evaluate whether a tag is present in the zone. By forming the third and fourth signals to be indicative of the absolute values of the first and second processed signals, cancellation effects are avoided. Tag detection is thereby enhanced.

In a further aspect of the invention, the front-end processor is further adapted to process the received signals such that the shield-spike interference is extracted over a period of time without also extracting the tag signal content. With the front-end processor so adapted, the first and second transmitter antennas of the system can be driven with drive signals having a phase difference of other than 0° or 180°. This results in a transmitted field in the interrogation zone having field components in all directions.

In yet a further aspect of the present invention, with the front-end processor also adapted as above-described, the further processing of the front-end processed signals is conducted over the entire extent of the period of the transmitter drive signals. For a given transmitted field level, this permits improved detection at a given width of the interrogation zone. It also allows the width of the zone to be increased. Finally, it allows the transmitted field to be reduced for the same detection level at a given zone width.

In still a further aspect of the invention, the tag evaluation processor processes the received signals in the time domain first. If this analysis confirms the presence of a pre-selected peak signal the frequency domain analysis is then conducted after a predetermined time delay. This insures that the time domain and frequency domain analysis is of the same received signals.

In the embodiment of the invention to be disclosed hereinbelow, the front-end processor is adapted to extract the shield-spike interference without extracting the tag signal content as in the '991 patent by phase locking the transmit signal to the power line signal and by using a time delay filter having a delay related to the period of the power line signal and the transmitted signal to filter the received signals.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
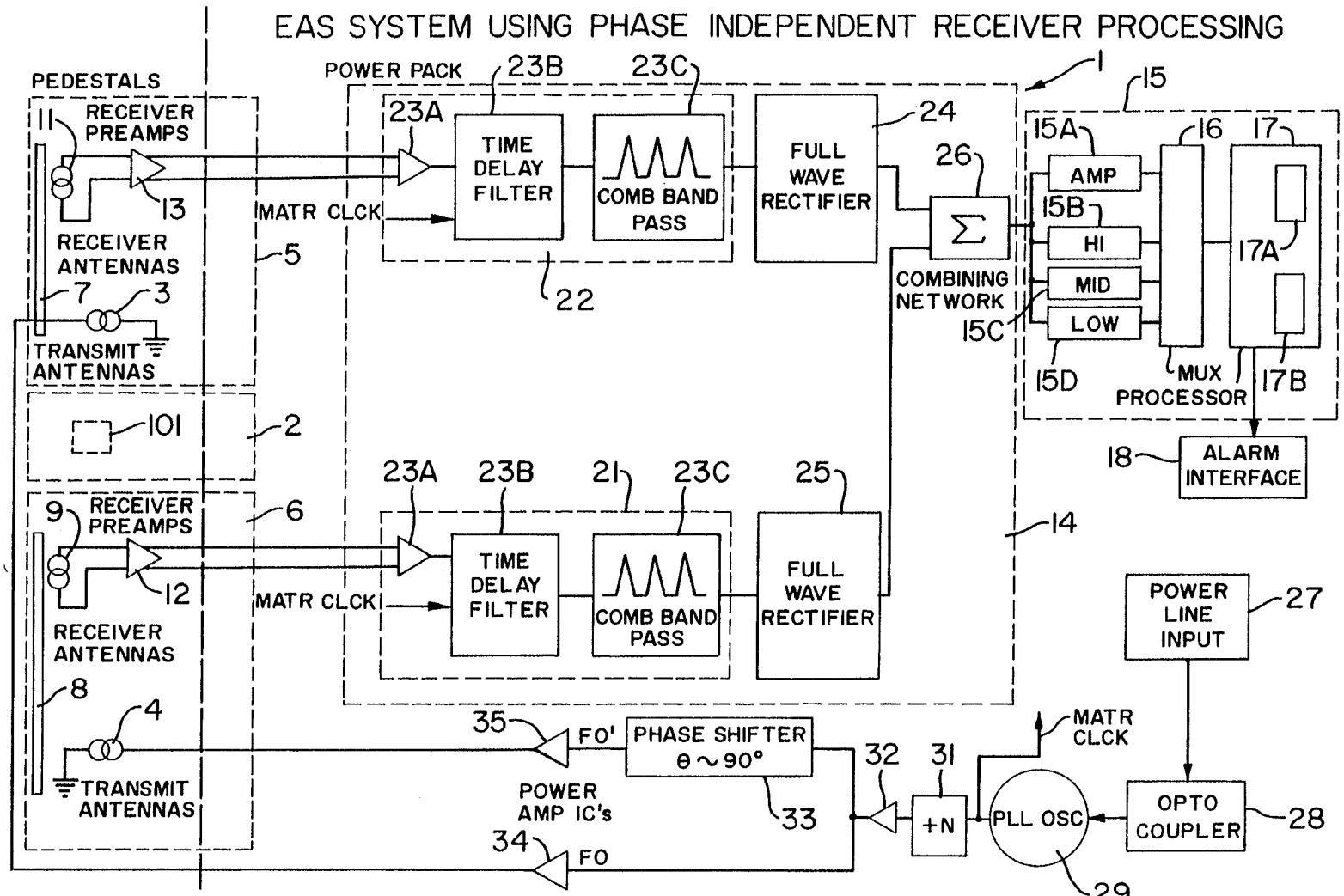
FIG. 1 shows an EAS system in accordance with the principles of the present invention.

FIG. 1 .Shows an EAS system 1 of the type described in the '991 patent, the teachings of which are incorporated herein by reference. The purpose of the system 1 is to detect the presence of magnetic tags 101 in an interrogation zone 2.

To this end, the system 1 includes first and second transmitter antennas 3 and 4 housed within pedestals 5 and 6 which are situated in facing, opposing relationship bordering the zone 2. The transmitter antennas 3 and 4 transmit magnetic fields or signals at a transmitter frequency $F_o$ into the zone 2 for sensing or detecting the presence of any tags 101. Shielding in the form of shields 7 and 8 is provided in the respective pedestals 5 and 6 to confine the transmitted signal.

Receiver antennas 9 and 11 receive magnetic signals from the zone 2 and couple the received signals through pre-amplifiers 12 and 13 to a front-end processor 14. The front-end processor 14 is adapted to remove interference signal content from the received signals and to minimize cancellation effects in a manner to be discussed in greater detail hereinbelow.

The front-end processor 14 produces an output signal which is coupled to a tag evaluation processor 15. The processor 15 carries out time and frequency domain processing of the output signal in the manner described in the '991 patent as modified in accordance with the discussion below.

More particularly, as shown, the processor 15 includes a time domain channel 15A which develops digital samples of the amplitude of the output signal. The processor 15 also includes three frequency domain channels 15B, 15C and 15D. These channels develop DC signals associated with the frequency content of the output signal in high, middle and low-frequency bands. The latter bands are pre-selected to encompass harmonics of the transmitter frequency $F_o$ expected to occur in the received signals.

The signals from the time and frequency domain channels 15A–15D are coupled to a multiplexer 16 which makes the signals available to a program driven processor 17 when appropriately addressed by the processor. The processor 17 processes the digital samples from the time domain channel in accordance with a time domain algorithm 17A. It further processes the DC signals from the frequency domain channels 15B–15D in accordance with a further frequency domain algorithm 17B. This processing occurs over a number of half cycles or frames of the transmitted signal. If the result of the processing indicates a tag 101 is present in the zone 2, the processor 17 sends a signal to an alarm interface 18 which causes an alarm to be sounded.

In accordance with the principles of the present invention, the front end processor 14 is adapted to independently initially process the received signals from the pre-amplifiers 12 and 13 via processing channels 21 and 22, respectively. Each processing channel 21 and 22 is of like construction and includes an amplifier 23A, a time delay filter 23B and a comb bandpass filter 23C. The time delay filters 23B have time delays which are determined by a master clock signal MC having a frequency $F_c$ and remove time invariant interference signal content in the amplified signals from the amplifiers 23A. The comb bandpass filters 23C have bandpasses centered at harmonics of the transmitter frequency $F_o$ and, thus, extract additional interference signal content at frequency between these bandpasses.

The processed signals from the channels 21 and 22 are passed to respective full wave rectifiers 24 and 25. The full wave rectifiers 24 and 25 produce signals of the same polarity which correspond to the absolute values of their respective processed signals. The rectified signals are then conveyed to an adder or combining circuit or network 26. The network 26 adds the signals to generate a combined signal which serves as the output signal of the front-end processor 14.

As can be appreciated, by using the independent processing channels 21 and 22 to process the received signals from the antennas 9 and 11 and then forming rectified signals of the same polarity corresponding to the absolute values of the processed signals, the subsequent combining of the rectified signals in the network 26 results in signals which reinforce one another. As a result, signal cancellation in the combined signal does not occur and the output signal from the front-end processor is caused to have a more pronounced tag signal content. This is in contrast to the '991 patent system in which the antenna signals from the receivers are merely added directly without forming absolute value signals, making the tag signal content subject to cancellation effects.

As above noted, each of the time delay filters 23B performs time delay filtering to remove or extract specified interference signal content (specifically, the power line and shield spike interference discussed above) and allow passage of specified tag signal content in its received signals. This is accomplished by configuring each filter and the drive for the transmitter antennas 3 and 4 in the manner described in the '681 patent, the teachings of which are also incorporated herein by reference.

More particularly, the drive signal for each of the transmitter antennas 3 and 4 is time locked or synchronized to a power line signal at the frequency $F_L$ developed by the power line input 27 to the system. The master clock signal MC used to establish the delay $T_d$ for the time delay filters 23B is, in turn, formed so as to have a period related to the period of the power line signal and the period of the transmitted signal (i.e., a period T equal to $1/F_o$).

The drive signal for each of the transmitter antennas is locked to the power line signal by a phase lock loop circuit 29 which receives the power line signal from an opto coupler 28. The phase lock loop circuit generates an output which is locked in time to the line signal and is at a frequency of M times the line frequency. This output is used directly as the master clock signal MC for the time delay filters.

A frequency divider 31 divides the frequency of the phase lock loop output by a factor N. This signal is amplified in amplifier 32 and the amplified signal then used to generate first and second drive signals having the frequency $F_o$ and the period T for driving the antennas 3 and 4. These drive signals are now also locked in time to the power line signal.

As a consequence of this arrangement, the power line interference and the shield spike interference, both of which are substantially stationary signals, are extracted by the filters 23B from their respective received signals. On the other hand, certain of the tag signal content in the received signals is passed by the filters. Specifically, the predominant tag signal content, which is non-stationary, is passed at all times by the filters, while any stationary tag signal content, which occurs less frequently, is passed at least over a number of cycles of the transmitted signals.

Due to the elimination of the shield spike interference in the received signals, it has been recognized that the first and second drive signals for the transmitter antennas 3 and 4 can now have a phase difference which is other than 180° or 0°. Accordingly, a phase-shifter 33 is provided to shift the phase of the drive signal applied to the antenna 4 by a phase angle $\theta$ (shown as approximately 90°) relative to the drive signal applied to the antenna 3. The drive signals are applied to the antennas via respective power amplifiers 34 and 35.

Figure 2:
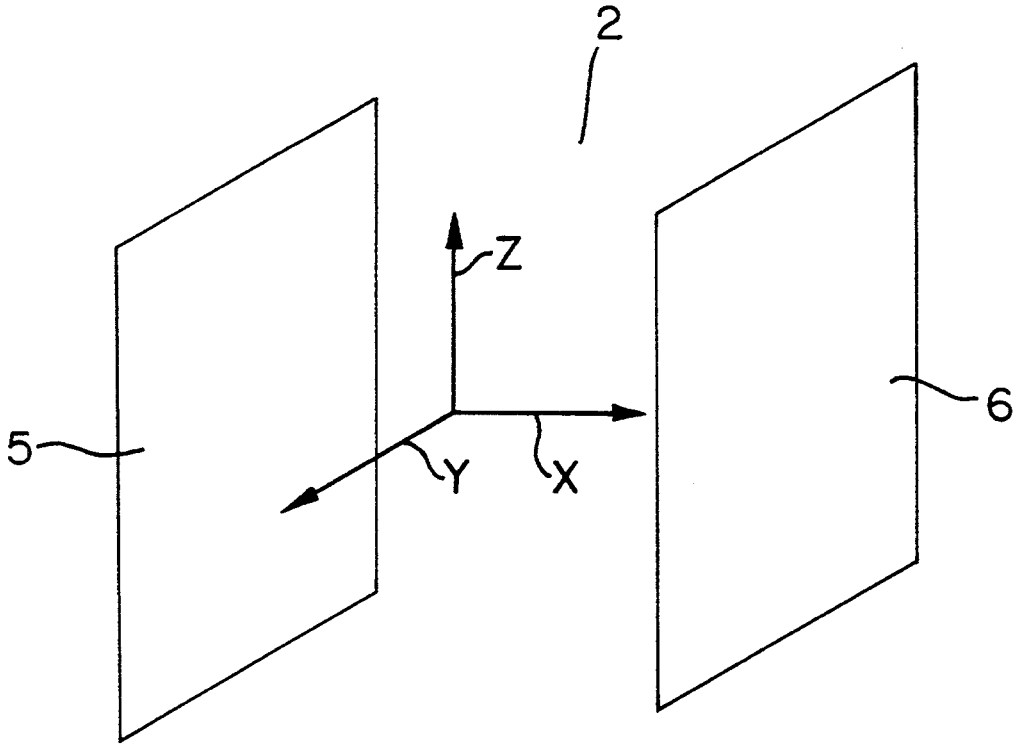
FIG. 2 shows the antenna pedestals of the EAS system of FIG. 1.

As can be appreciated, the phase difference between the drive signals driving the antennas 3 and 4 results in a similar phase difference between the magnetic fields generated by the antennas. Because this phase difference is other than 0° or 180°, the resultant field in the zone 2 will have content in substantially all directions, i.e., in the vertical Z, horizontal X and lateral Y directions (see, FIG. 2).

This permits better detection of the tags 101 in the zone 2, since there will always be a magnetic field component along the orientation direction of the tag. Again, this contrasts with the '991 patent system wherein the antennas were driven at 180° out-of-phase and, thus, because of field cancellation effects, did not have substantial field content in the middle of the interrogation zone in the horizontal direction.

As a further result of extracting the shield-spike content as above-described, it has also been recognized that the output signals from the front-end processor 14 can now be processed by the tag evaluation processor 15 over the entire period T of the drive signals. To this end, the processor 15 is adapted to acquire signals from the time domain and frequency domain channels 15A–15D on an interrupt basis over each entire half-period or frame of the drive signals. The processor, in turn, is further adapted to simultaneously process during each such half-period on a non-interrupt basis the signals acquired during the previous half-period.

As a result of this operation, the system 1 is now able to better and more efficiently detect the presence of tags in the interrogation zone 2. More particularly, where the system 1 is limited by the level of the transmitted field, detection of tags at a given width of the zone 2 will be improved. Also, for such systems, for the same level of detection, the zone width can be increased. Finally, for the same level of detection, the drive signal can be decreased for a given width of the zone.

The above contrasts with the '991 patent system wherein received signals were processed by the tag evaluation processor only during a finite window portion of each frame or half-period of the transmitter drive signals. This prevented the system from exhibiting the aforesaid benefits provided by the system 1.

In order to permit the evaluation processor 15 to properly evaluate the frequency and time domain signals in the channels 15A–15D, the processor is further adapted to first process the signals from the time domain channel. If a predetermined signal level is detected in the time domain signals, the processor 15 then processes the signals received from the frequency domain channels, after a specified time delay. This provides assurance that the frequency domain signals are for the same tag signal content as the time domain signals.

In the system embodying the present invention, the relationships between the frequencies $F_o$, $F_L$ and $F_c$ and the time delay $T_d$ can be expressed as follows:

$F_c/M=F_L$ $F_c/N=F_o$ $M1/F_L=N1/F_o=T_d$, where M1 and N1 are integers. In a typical embodiment of the system, these parameters can have the following values:

$F_L=60$ Hz $F_c=3.932160$ Mhz $M=65{,}536$ $N=53{,}248$ $M1=13$ $N1=16$ $F_o=73.846154$ Hz $T_d=0.216666$ sec In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What we claim is:

1. An EAS system for sensing tags in an interrogation zone, said EAS system comprising:

means for transmitting transmitter signals said interrogation zone;

front-end receiving and processing means including first and second receiving antennas for independently receiving from said interrogation zone first and second signals, respectively, said front-end receiving and processing means independently processing said first and second independently received signals, to produce third and fourth processed signals indicative of the absolute values of the independently processed first and second signals; and means for combining said third and fourth signals to produce a combined signal;

and tag evaluation processing means for further processing said combined signal for use in evaluating whether a tag is present in said interrogation zone.

2. An EAS system in accordance with claim 1 wherein:

said system further includes shielding means for confining said transmitter signals to said interrogation zone;

said transmitting means includes: first and second spaced opposing antennas; and means for driving said first and second antennas with first and second drive signals having a predetermined drive frequency and a predetermined period;

said first and second independently received signals comprising interference signal content including shield interference resulting from the interaction of said transmitter signals with said shielding means and tag signal content resulting from the interaction of said transmitter signals with a tag present in said interrogation zone; and said front-end receiving and processing means processes the respective first and second independently received signals such that the interference signal content present in said first and second independently received signals during a period of time is extracted without extracting the tag signal content present in said first and second independently received signals during said period of time.

3. An EAS system in accordance with claim 2 wherein:

said first and second drive signals have a phase difference which is other than 0° and 180°.

4. An EAS system in accordance with claim 3 wherein:

said tag evaluation processing means is adapted to receive and process said combined signal during the entire extent of said predetermined period of said first and second drive signals.

5. An EAS system in accordance with claim 4 wherein:

said tag evaluation processing means conducts time and frequency domain processing of said combined signal.

6. An EAS system in accordance with claim 5 wherein:

said tag evaluation processing means conducts said time domain processing of said combined signal and, if a signal of predetermined level is detected, conducts said frequency domain processing of said combined signal after a predetermined time delay.

7. An EAS system in accordance with claim 6 wherein:

said tag evaluation processing means includes: a time domain channel for providing time domain information regarding said combined signal; a number of frequency domain channels for providing frequency domain information regarding said combined signal; and a processor which, during each half of said predetermined period of said first and second drive signals, receives the time domain and the frequency domain information being generated during that half of said predetermined period on an interrupt basis and conducts said time domain and frequency domain processing on a non-interrupt basis for the frequency and time domain information received and generated during the preceding half of said predetermined period.

8. An EAS system in accordance with claim 4 wherein:

said front-end receiving and processing means receives and processes said first and second signals from said interrogation zone during the entire predetermined period of said first and second drive signals.

9. An EAS system in accordance with claim 4 wherein:

said drive means is responsive to a power line signal at a predetermined power line frequency; and said interference signal content includes power line interference resulting from said power line signal.

10. An EAS system in accordance with claim 4 wherein:

said front-end receiving and processing means further includes: first and second time delay filters for receiving from said first and second receiving antennas said first and second independently received signals, respectively.

11. An EAS system in accordance with claim 10 wherein:

said front-end receiving and processing means further comprises: first and second comb band-pass filters responsive to said first and second time delay filters, respectively; and first and second rectifier circuits responsive to said first and second band-pass filters, respectively, and whose outputs form said third and fourth processed signals, respectively.

12. An EAS system in accordance with claim 11 wherein:

said drive means is locked in time to a power line signal at a predetermined power line frequency;

said interference signal content includes power line interference comprised of signals at said power line frequency and harmonics of said power line frequency;

said shield interference includes shield spikes spaced in time one from the other at an interval equal to one-half said predetermined period of said first and second drive signals;

and each of said first and second time delay filters provides a delay related to the period of said power line signal and to the period of said transmitter signals.

13. An EAS system in accordance with claim 12 wherein:

each of said first and second time delay filters includes: delay means for receiving the input signals to the time delay filter; and means for substractively combining the input signals to the time delay filter and the output signals from said delay means.

14. An EAS system in accordance with claim 13 wherein:

each of said first and second comb band-pass filters has pass bands at the predetermined frequency and harmonics of the predetermined frequency of said first and second drive signals.

15. An EAS system in accordance with claim 10 wherein:

said transmitter signals are a magnetic signals;

and said tags are magnetic tags.

16. An EAS system in accordance with claim 15 further comprising:

one or more of said magnetic tags.

17. An EAS system in accordance with claim 3 wherein:

said first and second drive signals have a phase difference of about 90°.

18. An EAS system in accordance with claim 2 wherein:

said tag evaluation processing means is adapted to receive and process the combined signal during the entire extent of said predetermined period of said first and second drive signals.

19. An EAS system for sensing tags in an interrogation zone, said EAS system comprising:

transmitting means for transmitting transmitter signals into said interrogation zone, said transmitter signals being based upon drive signals having a predetermined frequency and predetermined period, said transmitting means including: first and second spaced opposing antennas; and means for driving said first and second antennas with first and second drive signals at said predetermined frequency and period and at a phase difference of other than 0° and 180°;

shielding means for confining said transmitter signals to said interrogation zone;

front-end receiving and processing means for receiving signals from said interrogation zone, said received signals comprising interference signal content including shield interference resulting from the interaction of said transmitter signals and said shielding means and tag signal content resulting from the interaction of said transmitter signals with a tag present in said interrogation zone, and said front-end receiving and processing means producing an output signal by processing said received signals such that the interference signal content present in said received signals during a period of time is extracted without extracting the tag signal content present in said received signals during said period of time;

and tag evaluation processing means adapted to further process the output signal from said front-end receiving and processing means during the entire extent of said predetermined period of said first and second drive signals for use in evaluating whether a tag is present in said zone.

20. An EAS system in accordance with claim 19 wherein:

said shield interference includes shield spikes spaced in time one from the other at an interval equal to one-half said predetermined period of said signals.

21. An EAS system in accordance with claim 19 wherein:

said tag evaluation processing means conducts time and frequency domain processing of said output signal.

22. An EAS system in accordance with claim 21 wherein:

said tag evaluation processing means conducts said time domain processing of said output signal and, if a signal of predetermined level is detected, conducts said frequency domain processing of said output signal after a predetermined delay time.

23. An EAS system in accordance with claim 22 wherein:

said tag evaluation processing means includes: a time domain channel for providing time domain information regarding said output signal; a number of frequency domain channels for providing frequency domain information regarding said output signal; and a processor which, during each half of said predetermined period of said drive signals, receives the time domain and the frequency domain information being generated during that half of said predetermined period on an interrupt basis and conducts said time domain and frequency domain processing on a non-interrupt basis for the frequency and time domain information received and generated during the preceding half of said predetermined period.

24. An EAS system in accordance with claim 19 wherein:

said front-end receiving and processing means receives and processes said received signals during the entire extent of said predetermined period of said drive signals.

25. An EAS system in accordance with claim 19 wherein:

said transmitting means is responsive to a power line signal at a predetermined power line frequency; and said interference signal content includes power line interference resulting from said power line signal.

26. An EAS system in accordance with claim 19 wherein:

said front-end receiving and processing means includes: first and second receiving antennas for receiving first and second received signals from said interrogation zone; and first and second time delay filters for receiving from said first and second antennas said first and second received signals, respectively.

27. An EAS system in accordance with claim 26 wherein:

said front-end receiving and processing means further comprises: first and second comb band-pass filters responsive to said first and second time delay filters, respectively; first and second rectifier circuits responsive to said first and second band-pass filters, respectively; and means for combining the output of said first and second rectifier circuits to produce said output signal.

28. An EAS system in accordance with claim 27 wherein:

said transmitting means is phase locked to a power line signal at a predetermined power line frequency;

said interference signal content includes power line interference comprised of signals at said power line frequency and harmonics of said power line frequency;

said shield interference includes shield spikes spaced in time one from the other at an interval equal to one-half said predetermined period of said drive signals;

and each of said first and second time delay filters provides a delay related to the period of said power line signal and the period of said transmitter signal.

29. An EAS system in accordance with claim 28 wherein:

each of said first and second time delay filters includes: delay means for receiving the input signals to the time delay filter; and means for substractively combining the input signals to the time delay filter and the output signals from said delay means.

30. An EAS system in accordance with claim 29 wherein:

each of said first and second comb band-pass filter has pass bands at the predetermined frequency and harmonics of the predetermined frequency of said drive signals.

31. EAS system in accordance with claim 19 wherein:

said transmitter signals are magnetic signals;

and said tags are magnetic tags.

32. An EAS system in accordance with claim 31 further comprising:

one or more of said magnetic tags.

33. An EAS system for sensing tags in an interrogation zone, said EAS system comprising:

transmitting means for transmitting transmitter signals into said interrogation zone, said transmitting means including: first and second spaced opposing antennas; means for driving said first and second antennas with first and second drive signals, said first and second drive signals having a predetermined frequency and a predetermined period and a phase difference which is other than one of 0° and 180°; shielding means for confining said transmitter signals to said interrogation zone;

front-end receiving and processing means for receiving signals from said interrogation zone, said received signals comprising interference signals content including shield interference resulting from the interaction of said transmitter signals and said shielding means and including tag signal content resulting from the interaction of said transmitter signals with a tag present in said interrogation zone, and said front-end receiving and processing means processing said received signals such that the interference signal content present in said received signals during a period of time is extracted without extracting the tag signal content present in said received signals during said period of time;

and tag evaluation processing means for further processing the signals from said front-end receiving and processing means for use in evaluating whether a tag is present in said interrogation zone.

34. An EAS system in accordance with claim 33 wherein:

said transmitter signals are magnetic signals;

and said tags are magnetic tags.

35. An EAS system in accordance with claim 34 further comprising:

one or more said magnetic tags.

* * * * *